US008602748B2

(12) United States Patent
Armenio et al.

(10) Patent No.: US 8,602,748 B2
(45) Date of Patent: Dec. 10, 2013

(54) PUMPING SYSTEM

(75) Inventors: Giacomo Armenio, Leghorn (IT); Bernardo Celata, Leghorn (IT)

(73) Assignee: Pierburg Pump Technology Italy S.p.A., Lanciano (IT)

( * ) Notice: Subject to any disclaimer, the term of this patent is extended or adjusted under 35 U.S.C. 154(b) by 1589 days.

(21) Appl. No.: 10/585,438

(22) PCT Filed: Jan. 5, 2005

(86) PCT No.: PCT/EP2005/050037

§ 371 (c)(1),
(2), (4) Date: Jun. 1, 2007

(87) PCT Pub. No.: WO2005/068838

PCT Pub. Date: Jul. 28, 2005

(65) Prior Publication Data

US 2008/0069704 A1 Mar. 20, 2008

(30) Foreign Application Priority Data

Jan. 9, 2004 (IT) ..... BO2004A0008

(51) Int. Cl.
*F04B 49/00* (2006.01)
*F01C 20/22* (2006.01)

(52) U.S. Cl.
USPC ..... 417/220; 418/31

(58) Field of Classification Search
USPC ..... 417/32, 220, 392; 418/31
See application file for complete search history.

(56) References Cited

U.S. PATENT DOCUMENTS

| | | | | |
|---|---|---|---|---|
| 2,716,946 | A * | 9/1955 | Hardy | 417/213 |
| 4,510,962 | A * | 4/1985 | Mott et al. | 137/102 |
| 5,800,131 | A | 9/1998 | Lehmann et al. | |
| 2003/0031567 | A1 | 2/2003 | Hunter et al. | |

OTHER PUBLICATIONS

International Search Report, PCT/EP2005/050037, Jan. 5, 2005.

* cited by examiner

*Primary Examiner* — Charles Freay
(74) *Attorney, Agent, or Firm* — Robert P. Lenart, Esq.; Pietragallo Gordon Alfano Bosick & Raspanti, LLP

(57) ABSTRACT

A pumping system having a pump, such as a variable-displacement vane pump or a gear pump. The pump in turn has hydraulic pressure-control dissipating devices for imparting to the oil in a first control chamber a pressure lower than the pressure of a second chamber. The system is characterized in that the first control chamber of the pump has a channel connecting the first control chamber to an oil inlet. And the channel has an opening/closing device controlled selectively by an engine operating parameter, such as oil temperature.

5 Claims, 4 Drawing Sheets

PUMPING SYSTEM

TECHNICAL FIELD

The present invention relates to a pumping system. More specifically, the present invention relates to control of a variable-displacement vane pump or gear pump.

Though reference is made in the following description to a variable-displacement vane pump, the teachings of the present invention may also be applied to advantage to a gear pump (not shown).

BACKGROUND ART

As is known, vane pumps of the above type are currently used for pumping various fluids, such as lubricating oil in an internal combustion engine.

In the present invention, operation of the pump is controlled by delivery pressure and a further parameter, e.g. oil temperature.

Pumping systems are known, in fact, which are controlled not only by the delivery pressure of the pump but also by oil temperature.

Two such control systems are described in U.S. Pat. No. 5,800,131 and FR-2 825 419, in which a member sensitive to variations in oil temperature acts directly on the pump ring to vary the eccentricity, and therefore displacement, of the pump as a function of lubricating oil temperature. More specifically, eccentricity (and therefore displacement) of the pump is increased by the control system as a function of the increase in oil temperature, to meet higher oil demand by the internal combustion engine.

Existing control systems of this type, however, have not proved altogether satisfactory, by subjecting the ring to severe forces that are difficult to control.

DISCLOSURE OF INVENTION

It is therefore an object of the present invention to provide a straightforward hydraulic control for controlling a pump, e.g. a variable-displacement vane pump, as a function of delivery pressure and another engine operating parameter, such as oil temperature.

According to the present invention, there is provided a pumping system as claimed in Claim 1.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

For a clear understanding of the present invention, reference will first be made to the known system in FIG. 1, which is the object of the Applicant's International Application PCT/EP2004/052140, and on which the system according to the present invention is based.

Figure 1:
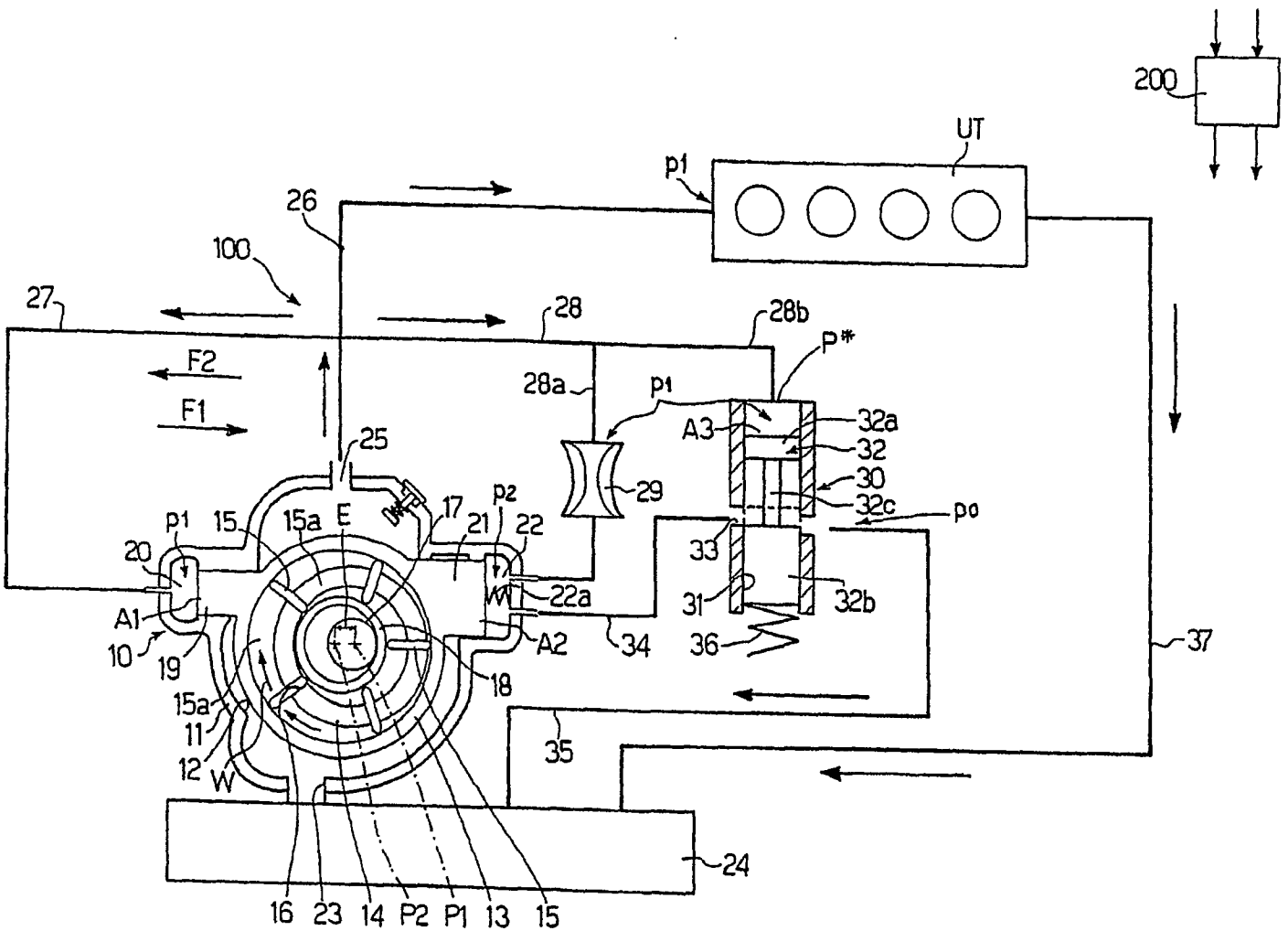
PRIOR ART Fig.1
FIG. 1 shows a prior-art system on which the system according to the present invention is based.

Number 10 in FIG. 1 indicates a variable-delivery vane pump forming part of a pumping system 100 which is the object of the Applicant's Italian Patent Application BO2003A000528.

Pump 10 comprises, in known manner, a main body 11 having a cavity 12, in which a ring 13 translates as explained in detail later on.

Ring 13 houses a rotor 14 having vanes 15, which are movable radially inside respective radial slots 16 formed in rotor 14, which in turn is rotated in the direction indicated by arrow W (see below).

Main body 11 is closed by a cover not shown in the accompanying drawings.

In known manner, rotor 14 houses a shaft 17 connected mechanically to rotor 14; and a floating ring 18 surrounding shaft 17, and on which rest respective ends of vanes 15.

Shaft 17 therefore has a permanently fixed centre P1, and ring 13 a centre P2.

The distance P1P2 represents the eccentricity E of pump 10.

As is known, by varying eccentricity E, the delivery of pump 10 can be varied as a function of demand by a user device UT downstream from pump 10 (see below).

User device UT may be defined for example by an internal combustion engine (not shown).

As shown in FIG. 1, ring 13 comprises a projection 19 housed partly inside a chamber 20; and a projection 21 housed partly inside a chamber 22. Projections 19 and 21 are located on opposite sides of centre P2 of ring 13, and have, respectively, a front surface A1 facing chamber 20, and a front surface A2 facing chamber 22. For reasons explained later on, surface A2 is larger than surface A1 and, on the basis of theoretical calculations and experiments, must be 1.4 to 1.7 times surface A1.

Chamber 22 also houses a spring 22*a* , which exerts a modest force on surface A2 to restore the control system to maximum eccentricity E when system 100 is idle.

In the FIG. 1 embodiment, chambers 20 and 22 are formed in main body 11 of pump 10.

Main body 11 also comprises an oil inlet 23 from a tank 24, and an oil outlet 25 to user device UT.

A feed conduit 26, for supplying user device UT, extends from outlet 25.

As shown in FIG. 1, a first portion of the oil supply to user device UT is diverted to chamber 20 along a conduit 27, and a second portion of the oil is supplied to chamber 22 along a conduit 28.

More specifically, the second portion in conduit 28 is almost all supplied to chamber 22 along a conduit 28*a* and via a dissipating device 29, in which a calibrated pressure loss occurs when oil actually flows inside it.

Conduit 28 is connected by a conduit 28*b* to a valve 30.

Valve 30 comprises a cylinder 31 housing a piston 32.

More specifically, as shown in FIG. 1, piston 32 comprises a first portion 32*a* and a second portion 32*b* connected to each other by a rod 32*c*.

Whereas portions 32*a* and 32*b* have the same cross section as cylinder 31, rod 32*c* has a smaller cross section than cylinder 31.

An opening 33 is formed in cylinder 31 and connected hydraulically to chamber 22 by a conduit 34.

Conduit 28*b* substantially provides for picking up a delivery pressure signal in conduit 28, so as to act on the front surface A3 of portion 32*a* of piston 32. Alternatively, conduit 28*b* may pick up the pressure signal at a point within the lubricating circuit.

The dash line in FIG. 1 shows the situation in which opening 33 is closed by second portion 32*b*.

As explained in more detail below, as soon as the delivery pressure (p1) increases as a result of an increase in rotation speed of pump 10, greater force is exerted on surface A3 and, on reaching the preload value of a spring 36, moves piston 32 to permit oil flow from conduit 34 through opening 33 and along a conduit 35 to tank 24.

At the start of conduit 35 and alongside valve 30, the oil is at atmospheric pressure (po).

Piston 32 is stressed elastically by spring 36, which is suitably sized and designed to generate a force only allowing movement of piston 32 when the delivery pressure (p1) on surface A3 reaches a given value.

A return conduit 37 from user device UT to tank 24 completes pumping system 100.

In the known art, eccentricity E is normally regulated by diverting a portion of the oil supply to a chamber, in which the delivery pressure acts directly on the ring. On the opposite side, the ring is subjected to an opposing elastic force generated by a spring, thus establishing the eccentricity E of the pump required to ensure the necessary oil pressure and flow to user device UT.

High rotation speed of shaft 17, and therefore of rotor 14 and vanes 15, however, has the effect of preventing complete fill of a number of cavities 15*a*, each located between two adjacent vanes 15. In actual fact, this does not depend solely on the high speed of rotor 14, but also on the temperature and chemical-physical characteristics of the oil.

Incomplete fill of cavities 15*a* has the side-effect of producing a force which acts in the direction indicated by arrow F1 in FIG. 1.

As a result, the pressure to the user device is other than required, on account of this undesired force which, as stated, is substantially generated by incomplete oil fill of cavities 15*a*.

By way of a solution to the problem, an attempt has been made to disassociate control from these negative internal forces by providing the so-called"hydraulic control" shown in the present description.

As shown in FIG. 1, if the delivery pressure (p1) were present in both chambers 20 and 22, the fact, as stated, that surface A2 is greater than (preferably 1.4 to 1.7 times) surface A1 would produce a force in the direction indicated by arrow F2, and which would compensate the force (arrow F1) produced by incomplete fill of cavities 15*a* . In which case, maximum eccentricity E would be achieved.

The result, however, would be no adjustment at all. To obtain the desired adjustment, therefore, the oil pressure (p2) in chamber 22 must be made lower than the oil pressure (p1) in chamber 20.

In this connection, when the delivery pressure (p1) is high enough to generate a force on surface A3 of portion 32*a* capable of overcoming the elastic force of spring 36, piston 32 moves into the configuration shown by the continuous line in FIG. 1, and in which rod 32*c* of piston 32 is located at opening 33, thus permitting oil flow from chamber 22 to conduit 34 and back into tank 24 along conduit 35.

Oil therefore also flows along conduit 28*a* and through dissipating device 29, so that the pressure (p2) in chamber 22 is lower than the delivery pressure (p1).

In other words, the pressure (p2) in chamber 22 is lower than and disassociated from the pressure (p1) in chamber 20, so that ring 13 can be moved in the direction of arrow F1 to establish a balanced eccentricity E value giving the desired oil flow to user device UT.

More specifically, as the delivery pressure (p1) increases and reaches a value (p*) determined by the characteristics of spring 36, piston 32 starts moving so that part of the oil leaks through opening 33. Valve 30 therefore also acts as a pressure dissipating member to assist in creating the desired pressure (p2) in chamber 22.

At the end of the transient state, (p1) and (p*) are equal.

The control system has also proved stable.

That is, control continues as long as piston 32 allows, i.e. control is taken over by valve 30, which is regulated exclusively by the delivery pressure (p1) and is unaffected by harmful internal forces.

Whereas in other control systems, the delivery pressure (p1) increases, remains constant for a while, and then decreases.

In the control system employed in the FIG. 1 system 100, on the other hand, once the value required by user device UT is reached, pressure (p1) remains constant, even at high rotation speeds of rotor 14.

When the delivery pressure reaches the value of pressure (p*), substantially determined by the characteristics of spring 36, generation of pressure (p2) commences, and ring 13 begins moving in the direction of arrow F1 to reduce eccentricity E and, therefore, the displacement of pump 10. Consequently, the delivery pressure (p1) falls and tends to assume a value below (p*), so that piston 32 reduces opening 33 and moves into an intermediate balance position.

Displacement remains fixed up to a given pressure (p1) value, and, alongside an increase in engine speed, flow increases, and, on reaching a given pressure (p*) value, valve 30 starts to open, and oil begins flowing along conduit 34, through opening 33, and along conduit 35 to tank 24. The pressure (p2) in chamber 22 therefore falls below (p1), so that ring 13 moves in the direction of arrow F1 to reduce displacement and, therefore, oil flow to user device UT.

The present invention will now be described with reference to FIGS. 2-6.

Figure 2:
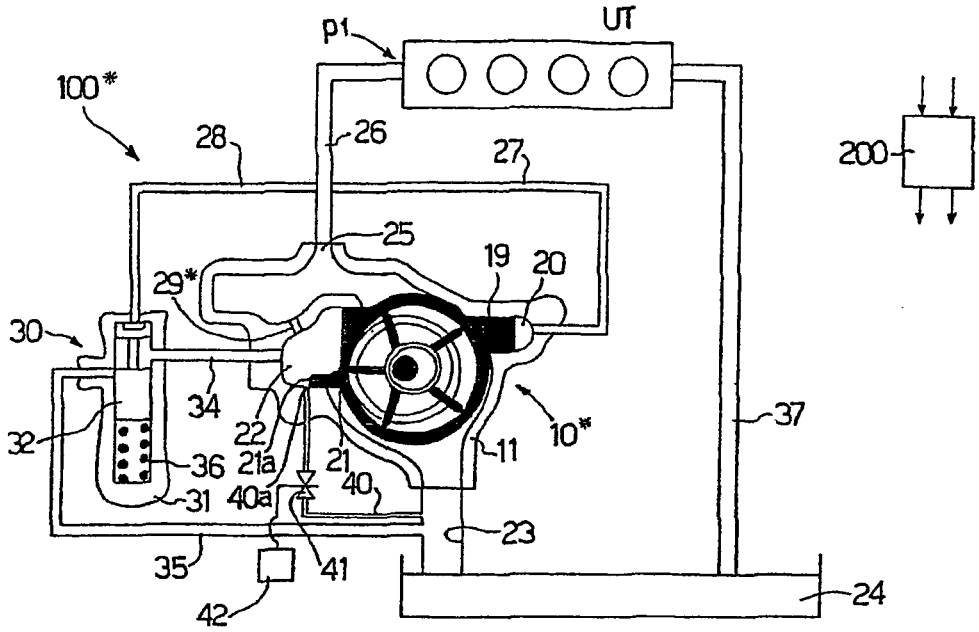
FIG. 2 shows a first configuration of the system according to the present invention.
Figure 3:
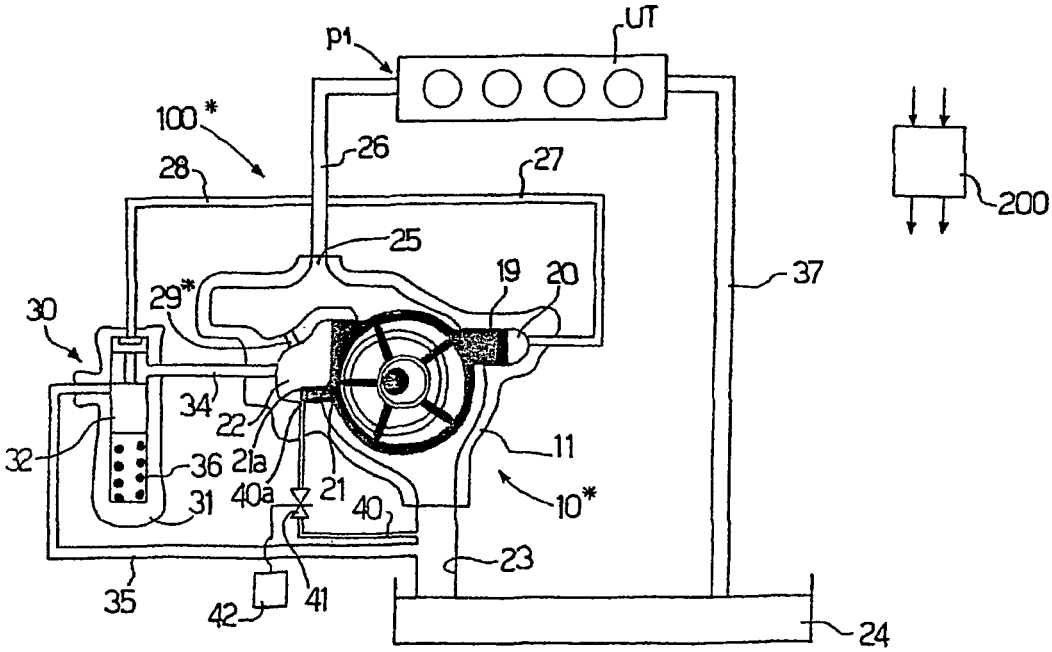
FIG. 3 shows a second configuration of the FIG. 2 system.
Figure 4:
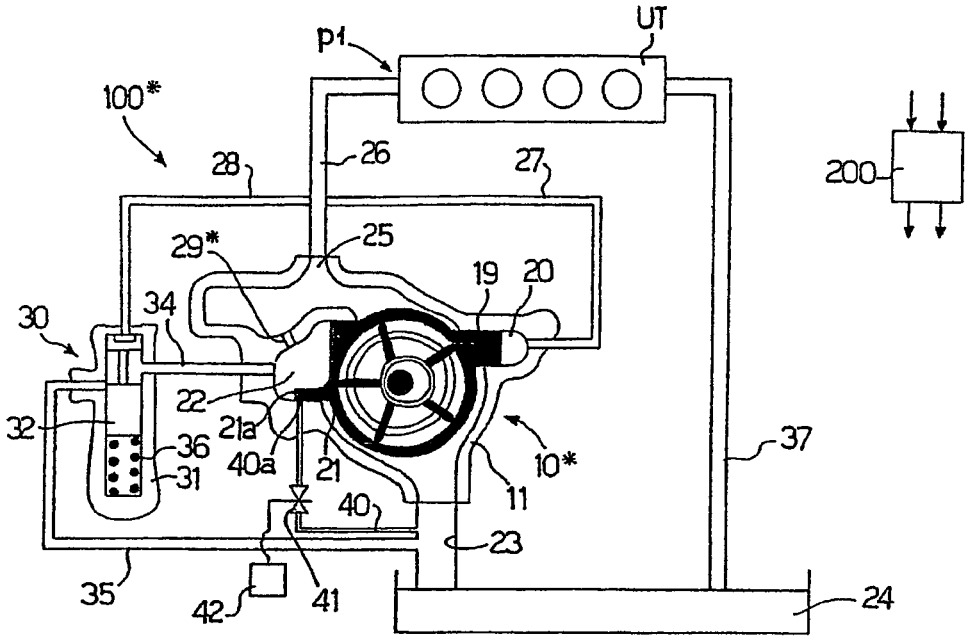
FIG. 4 shows a third configuration of the FIG. 2 system.
Figure 5:
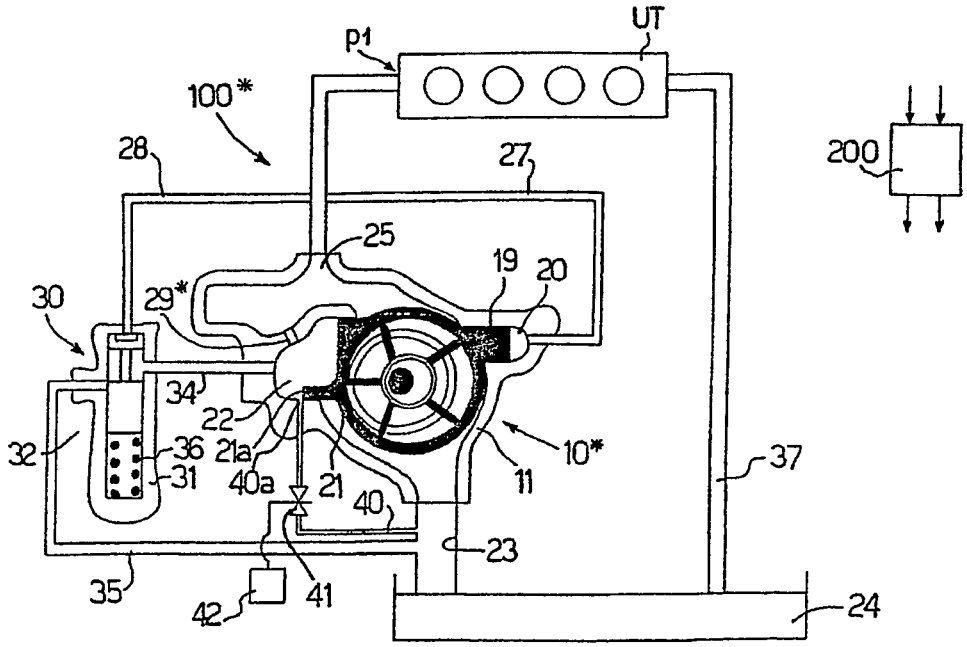
FIG. 5 shows a fourth configuration of the FIG. 2 system.

FIG. 2 substantially shows a system 100*, which represents a variation of system 100 in FIG. 1. In particular, changes have been made to pump 10, which, for the sake of simplicity, will now be referred to as pump 10*.

Pump 10* in FIG. 2 differs from pump 10 in FIG. 1 by projection 21 of pump 10* having a nose 21*a* projecting inside oil-filled chamber 22.

Pump 10* also comprises a conduit 40 connecting chamber 22 to inlet 23. Since inlet 23 is permanently at atmospheric pressure, conduit 40, when open, obviously sets chamber 22 to atmospheric pressure (po).

Conduit 40 is fitted with a valve 41 operated by a sensor 42, which, on detecting a physical quantity, e.g. oil delivery temperature, opens/closes valve 41.

As opposed to operating valve 41 directly by sensor 42, the data detected by sensor 42 may be first reprocessed by an electronic central control unit 200, which controls opening/closing of valve 41.

For construction reasons, in the FIG. 2-5 embodiment of the present invention, dissipator 29 is preferably replaced by a conduit 29* formed on main body 11 and connecting chamber 22 to outlet 25. Hydraulically, however, and particularly as regards dissipation, conduit 29* is obviously equivalent to dissipator 29.

FIGS. 2-5 show different operating configurations of pump 10* of system 100*, in which control is performed simultaneously by pressure and another parameter, e.g. oil temperature.

As explained in detail below, pressure control is continuous, whereas temperature control is performed in two stages.

FIG. 2 shows the pump 10* configuration, in which nose 21*a* is withdrawn from conduit 40, and the oil temperature T is below a reference value T* established by the maker.

As such, valve 41 is open, and chamber 22, being connected, as stated, to inlet 23 by conduit 40, is at atmospheric pressure (po).

Since the pressure (p1) in chamber 20 is higher than the pressure (po) of the oil in chamber 22, ring 13 moves rapidly leftwards to rapidly reduce eccentricity E.

At this stage, there is no pressure adjustment.

Nose 21*a* continues moving leftwards and begins closing mouth 40*a* of conduit 40 (FIG. 2). When mouth 40*a* is closed completely by nose 21*a* (FIG. 3), pressure control as described with reference to FIG. 1 may begin.

If oil temperature T is higher than value T*, however, pressure should be controlled over the entire eccentricity E range. In this case, therefore, the control system closes valve 41 from the outset to immediately activate control as described with reference to FIG. 1.

In other words, conduit 40 is closed either by the movement of ring 13 causing nose 21*a* to close mouth 40*a* of conduit 40, or by closure of valve 41 (controlled directly by sensor 42 or via electronic central control unit 200) when oil temperature T exceeds a set value T*.

For a clearer understanding of the present invention, reference will now be made to FIG. 6, which shows an example of control of pump 10*.

As is known, a requisite of automotive internal combustion engines is low consumption at low engine speed (e.g. below 2000 rpm).

Another given is the fact that a lubricating circuit acts in the same way as a hydraulic conduit containing the drive shaft, camshaft, etc.

Contrary to what might be thought, the oil flow necessary to maintain a constant pressure in the circuit does not depend to a great extent on the speed of the moving parts.

Figure 6:
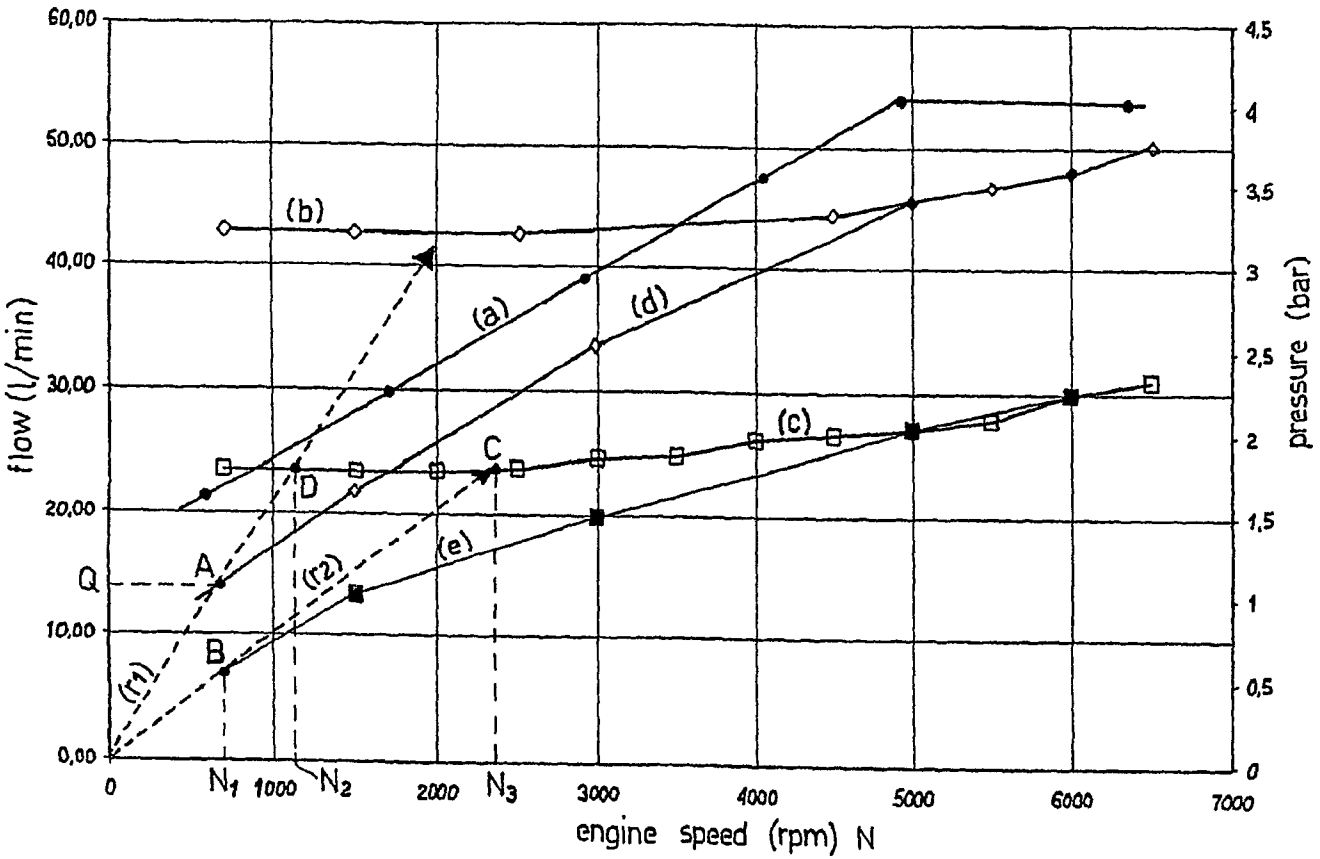
FIG. 6 shows a graph illustrating control of the FIGS. 2-5 system.

In FIG. 6, curve (a) shows the minimum pressures permitting lubrication at engine speeds N regardless of temperature.

Assuming a target pressure, for example, of 4 bars, at which the control system is activated (activation pressure of spring 36), such a pressure requires a given oil flow, which mainly depends, not on engine speed, but on oil temperature.

Curve (b) shows the flow-engine speed test results relative to 140° C. temperature and 4-bar pressure.

Curve (c) shows the flow-engine speed test results relative to 90° C. temperature and 4-bar pressure.

In other words, curves (b) and (c) show the permeability of the hydraulic circuit at 140° C. and 90° C. respectively, to obtain a 4-bar pressure.

Over 5000 rpm, since curve (a) is at a constant 4-bar value, curves (b) and (c) coincide with curves (d) and (e) respectively.

Curves (d) and (e) show, as a function of engine speed at temperatures of 140° C. and 90° C. respectively, the flow necessary to obtain the minimum required pressure values (curve (a)).

For example, at 3000 rpm, to obtain 3 bars in curve (a), 35 l/min are required with a lubricating oil temperature of 140° C., and 20 l/min with a lubricating oil temperature of 90° C. This is due to the fact that an increase in temperature reduces viscosity and density, so that greater flow is required to achieve the same pressure (3 bars, in the above example).

An ideal pump 10*, therefore, is one which, at 3.1 bar pressure and 3000 rpm, gives a flow of 35 l/min with an oil temperature of 140° C., and 20 l/min with an oil temperature of 90° C., etc. For accurate control, pump 10* should therefore be electronically controlled. In the example shown, however, a non-electronically-controlled pump 10* must suffice.

Using a variable-displacement pump 10*, the slope of the characteristic curve of pump 10* can be varied to adapt operation of the pump to the real flow demand of the control system.

The design point of pump 10* is represented by point (A) (FIG. 6), which is the point corresponding to the minimum flow Q, at a minimum engine speed (N1) and at maximum operating temperature (140° C. in the example), ensuring acceptable lubrication of the hydraulic circuit, i.e. 1.5 bar pressure (curve (a)).

Moving along line (r1), i.e. if speed and flow are increased, a point (D) is reached, at which control commences at 90° C. and at an engine speed N2, in the example, of around 1100 rpm.

Switching from line (r1) to line (r2), however, i.e. by varying the displacement of pump 10*, control commences at point (C), i.e. at an engine speed N3 of around 2400 rpm, much higher than speed N2.

With a conventional control system not permitting a rapid change in displacement of pump 10*, energy is therefore dissipated from point (D) onwards; whereas, with the control system according to the present invention, energy is dissipated from point (C) onwards, i.e. much later, with obvious advantages in terms of energy saving.

In other words, when a pump 10* with the design point at point (A) operates at 90° C., control commences at point (D); whereas a pump 10* capable of reducing its displacement and switching from line (r1) to line (r2) could operate at 90° C. according to the characteristic curve through point (B), and, when operating at 90° C., would commence control at point (C), thus avoiding high-pressure operation (in the example shown, maximum 4-bar pressure) between point (C) and point (D). This characteristic of the control system is advantageous by optimizing consumption, as intended, at low speed.

The FIG. 6 curves simply confirm what has already been stated, i.e. that line (r1) must approximate as closely as possible curve (d), and line (r2) must acceptably approximate curve (e), at least at technically pertinent speeds (the most frequent speeds in the consumption/emission evaluation cycle), i.e. between 1000 and 2000 rpm. It is therefore vital that, in accordance with the teachings of the present invention, displacement of pump 10* be variable rapidly to move ring 13 leftwards as fast as possible and independently of operating pressure. Which variation in displacement translates, as stated, in a rapid switch in operation of pump 10* as shown by line (r1) to operation as shown by line (r2) (FIG. 6).

The invention claimed is;

1. A pumping system comprising:

a variable-displacement vane pump and a user device connected to said variable-displacement vane pump by a delivery conduit;

pressure control means for setting said variable-displacement vane pump to a balanced configuration to supply an oil flow demanded by said user device, wherein said pressure control means comprises hydraulic dissipating means for imparting to the oil in a first control chamber forming part of said variable-displacement vane pump, a pressure lower than a control pressure in a second chamber;

said variable-displacement pump further comprising a ring which houses a rotor having vanes which are movable radially inside respective slots formed in said rotor; and a channel connecting said first control chamber to an oil inlet permanently at atmospheric pressure; said ring comprising a projection having a nose projecting inside said first control chamber, wherein movement of the ring causes said nose to selectively close said channel.

2. The pumping system of claim 1, wherein said channel comprises opening/closing means controlled selectively by an operating parameter.

3. The pumping system of claim 2, wherein said operating parameter is the temperature of the oil pumped by said pump.

4. The pumping system of claim 2, wherein the opening/closing means comprises:

a valve.

5. The pumping system of claim 4 wherein the valve is controlled by a pressure in a second control chamber.

* * * * *

UNITED STATES PATENT AND TRADEMARK OFFICE

CERTIFICATE OF CORRECTION

PATENT NO. : 8,602,748 B2
APPLICATION NO. : 10/585438
DATED : December 10, 2013
INVENTOR(S) : Giacomo Armenio et al.

It is certified that error appears in the above-identified patent and that said Letters Patent is hereby corrected as shown below:

On the Title Page, Item (75)

Inventor Information
"...Armenio, Leghorn (IT)" should read "...Armenio, Livorno (IT)"

Inventor Information
"...Celata, Leghorn (IT)" should read "...Celata, Livorno (IT)"

Signed and Sealed this
Ninth Day of September, 2014

Michelle K. Lee

Michelle K. Lee
*Deputy Director of the United States Patent and Trademark Office*